US011181252B2

(12) United States Patent
Callahan

(10) Patent No.: US 11,181,252 B2
(45) Date of Patent: Nov. 23, 2021

(54) APPARATUS FOR STEERING A LIGHT BEAM USING TWO MIRRORS HAVING ONLY ONE MIRROR MOVED

(71) Applicant: Michael Callahan, New York, NY (US)

(72) Inventor: Michael Callahan, New York, NY (US)

( * ) Notice: Subject to any disclaimer, the term of this patent is extended or adjusted under 35 U.S.C. 154(b) by 0 days.

(21) Appl. No.: 16/596,002

(22) Filed: Oct. 8, 2019

(65) Prior Publication Data

US 2020/0109836 A1 Apr. 9, 2020

Related U.S. Application Data

(60) Provisional application No. 62/743,095, filed on Oct. 9, 2018.

(51) Int. Cl.
*F21V 14/04* (2006.01)
*F21V 7/00* (2006.01)

(52) U.S. Cl.
CPC ..... *F21V 14/04* (2013.01); *F21V 7/0033* (2013.01)

(58) Field of Classification Search
CPC ..... F21V 7/0033; F21S 41/365; F21S 41/67; F21S 41/675; F21W 2131/406; G02B 26/0816; G03B 2215/0528; G03B 2215/0585; G03B 21/2066; G03B 15/02
USPC ..... 362/287, 294, 277, 273, 404, 367
See application file for complete search history.

(56) References Cited

U.S. PATENT DOCUMENTS

| | | | |
|---|---|---|---|
| 819,611 | A | 5/1906 | Sohlberg |
| 2,054,224 | A | 9/1936 | Levy |
| 2,950,382 | A | 12/1956 | Hatch |
| 3,594,566 | A | 7/1971 | Kneisley |
| 3,845,351 | A | 10/1974 | Ballmoos et al. |
| 4,663,698 | A | 5/1987 | Tomlinson |
| 4,697,227 | A | 9/1987 | Callahan |
| 4,729,071 | A | 3/1988 | Solomon |
| 4,769,743 | A | 9/1988 | Callahan |
| 4,777,568 | A | 9/1988 | Solomon |
| 4,827,387 | A | 5/1989 | Ferren et al. |

(Continued)

FOREIGN PATENT DOCUMENTS

| | | |
|---|---|---|
| EP | 0 226 428 | 6/1987 |
| EP | 0 564 828 A1 | 10/1993 |
| EP | 0 643 257 B1 | 3/1995 |

(Continued)

OTHER PUBLICATIONS

Michael Callahan, The Lighting Designer's Scalpel, Light & Sound America magazine, Nov. 2017, pp. 90-96, Plasa Media, Inc., USA.

(Continued)

*Primary Examiner* — Matthew J. Peerce
(74) *Attorney, Agent, or Firm* — Davidson, Davidson & Kappel, LLC

(57) ABSTRACT

Improvements are disclosed to lighting fixtures, support structures, interconnecting cabling, and other subjects. An improved method allows precise control of the beams of high power, long throw followspots by means of a steering mirror motorized in two axes. The beam is first directed upwards from the followspot by a first mirror to the steering mirror above. The range of elevations through which the beam can be steered is increased by displacing the steering mirror relative to the first mirror such that the portion of the beam between them is not vertical.

2 Claims, 37 Drawing Sheets

(56) References Cited

U.S. PATENT DOCUMENTS

| | | | | |
|---|---|---|---|---|
| 4,843,529 | A | 6/1989 | Izenour | |
| 4,890,208 | A | 12/1989 | Izenour | |
| 4,931,916 | A * | 6/1990 | Callahan | F21S 10/06 362/272 |
| 4,945,459 | A | 7/1990 | Ferren et al. | |
| 5,089,946 | A * | 2/1992 | Mayer | F21S 8/00 362/284 |
| 5,333,102 | A | 7/1994 | Oberman et al. | |
| 5,590,955 | A | 1/1997 | Bornhorst et al. | |
| 5,816,690 | A | 10/1998 | Romano et al. | |
| 6,412,972 | B1 * | 7/2002 | Pujol | G09F 19/18 348/E5.142 |
| 6,464,376 | B1 | 10/2002 | Willson | |
| 6,764,198 | B2 | 7/2004 | Chang | |
| 6,765,544 | B1 | 7/2004 | Willson | |
| 8,449,141 | B1 | 5/2013 | Hinrichs | |
| 8,680,972 | B2 | 3/2014 | Quadri | |
| 9,593,830 | B2 | 3/2017 | Conti et al. | |
| 9,683,722 | B2 | 6/2017 | Quadri et al. | |
| 10,678,220 | B2 | 6/2020 | Farnik et al. | |
| 2003/0025649 | A1 | 2/2003 | Willson | |

FOREIGN PATENT DOCUMENTS

| | | | |
|---|---|---|---|
| GB | 2106233 | A | 4/1983 |
| GB | 2172122 | A | 9/1986 |

OTHER PUBLICATIONS

George Izenour, Theater Technology, book, pp. 216-219, copyright 1988, McGraw Hill Book Company, USA.
Undated TeleScan Print Ad.
Christie Electric Corp., "HAL" Followspot print ad, one page, undated.
Cameleon SARL, Telescan Mark II brochure, 4 pages, undated.
ETNow webpage, "Hardware Xenon Introduce 7000W Followspot with Image Scanner", dated Sep. 22, 2003.
Pancan, "Light in the Right Direction" brochure, 4 pages, undated.
Rosco Laboratories, Inc., "I-Cue Intelligent Mirror" cut sheet, one page, undated.
Vari-Lite, Inc., "VLM Moving Mirror" cut sheet, 2 pages, Apr. 1997.
Clay Paky s.r.l., "Golden Scan 2" cut sheet, 2 pages, undated.
Coemar s.p.a., Professional Catalogue, 35 pages, undated, pp. 16, 18, 23-24, 28.

* cited by examiner

Fig.1A
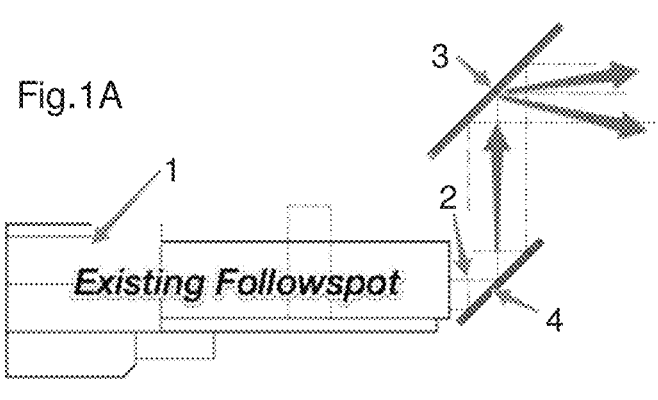
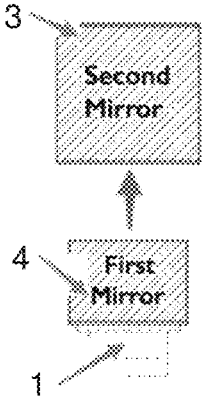
Fig.1B

APPARATUS FOR STEERING A LIGHT BEAM USING TWO MIRRORS HAVING ONLY ONE MIRROR MOVED

This application claims priority to Provisional Application No. 62/743,095, filed Oct. 9, 2018, the entire disclosure of which is hereby incorporated by reference.

PRIOR RELATED APPLICATIONS

This application is related to Provisional Application No. 61/973,592, filed Apr. 1, 2014; Utility application Ser. No. 14/676,616, filed Apr. 1, 2015, Utility application Ser. No. 15/614,902, filed Jun. 6, 2017; Utility application Ser. No. 15/945,987, filed Apr. 5, 2018; Provisional Application No. 62/743,095, filed Oct. 9, 2018; and Utility application Ser. No. 16/253,620, filed Jan. 22, 2019, the entire disclosures of which are hereby incorporated by reference.

BACKGROUND OF THE INVENTION

The subject matter is fixtures as can be employed in entertainment and event lighting, and specifically remote control of their beam direction.

Prior disclosures by the applicant include improvements to a class of lighting fixture known as the followspot, which is designed to readily vary during its use, multiple parameters (such as the azimuth, elevation, size, shape, color, and intensity) of its beam, traditionally by an adjacent operator, who points the fixture housing to direct the beam, and operates mechanisms modifying other beam parameters via projecting levers.

This requirement for an adjacent operator restricts placement to where both fixture and operator can both be safely accommodated, which, in turn, either limits the locations practical, or requires additional expenditures to create new ones.

A further consequence has been that, in large venues, practical locations often dictate long distances between the fixture and the subject illuminated ("throws"), requiring followspots that have both powerful light sources and highly directional optical systems, increasing their size and cost.

Further, as recited in prior related disclosures, with increasing distances/"throws", small changes in beam azimuth and elevation produce dramatic shifts in the location of the beam at the distant subject.

It has long been understood that remote control of a fixture used in this application would have many advantages, including allowing shorter "throws" and a wider choice of locations.

Such advantages have become increasingly important for several reasons.

One is the widespread use of "video-magnification" in many types of live performance and event, which renders close-ups of the principals on giant screens for audience viewing. Followspots are often the sole source of light on the principals and the angle of beam incidence has a major impact on their appearance. Remote followspots afford greater choice in fixture location and, therefore, angle.

Light levels have also markedly increased onstage, which can render previously acceptable followspot light levels insufficient; a consequence of using more and brighter fixtures and large LED surfaces. Remotely controlled fixtures can, in some cases, be located at shorter and more consistent "throws", increasing the light level delivered.

Remotely controlled light fixtures designed specifically as followspots date back more than a half-century.

So-called "automated" or "moving" lights designed for stored program control by a memory system (as disclosed in U.S. Pat. No. 3,845,351) have also been enlisted as remote followspots, but, as described in prior disclosures, proven less than satisfactory, including because of the difficulty of maintaining close control over the motion of their large and heavy heads, given the often wide variations in speed and abrupt changes in direction necessary in this application.

Clearly, the task becomes still more difficult when the subject-to-fixture distance reaches or exceeds about 150 feet, as is often required for frontal lighting in larger productions, because of both the substantial size and weight of a fixture having the necessary power, and the fine degree of control over its angular displacement required at these longer throws.

In large arenas or stadiums, positions for followspots are often hundreds of feet from the performer. "Moving lights" fall far short of the intensity needed. Purpose-built attended followspots with xenon sources of 2000-4000 watts have proven more acceptable, but they are limited in practical location, difficult to direct manually, and have been impractical to remote.

SUMMARY OF THE INVENTION

It is one object of the invention to disclose a method of controlling the direction of a fixture's beam, permitting the use of such existing high powered followspots, while also achieving the necessary quality of directional control.

A light fixture produces a directional light beam that enters the steering apparatus on a generally horizontal line. A mirror is motorized to steer the light beam in two axes. Another mirror first redirects the beam upward to intersect the steering mirror.

BRIEF DESCRIPTION OF THE DRAWINGS

FIG. 1A is a general schematic of a system capable directing the beam of a followspot by means of mirrors.

FIG. 1B is a frontal elevation of the prior Figure.

DETAILED DESCRIPTION

Refer now to FIG. 1 which includes the main housing or "head" 1 of a purpose-built followspot, such as those produced by Lycian Stage Lighting of Sugar Loaf, N.Y.

As well understood, housing 1 contains the light source, beam-forming optical system, and various mechanisms for changing the size, shape, color, and intensity of the beam produced Housing 1 is offered pivotally mounted atop a yoke, in turn pivotally supported by a base (neither here shown), permitting the adjustment of azimuth and elevation of housing 1 and thereby its beam.

By contrast, in FIGS. 1A and 1B, the beam 2 is steered by at least one motorized mirror 3. Such beam steering requires moving only the few pounds of mirror 3, rather than the hundred or more of housing 1. The mass and inertia of such a modest load is easily managed. Large and heavy existing followspots can be used, substantially without modification, to obtain the high power and narrow beams needed at longer throws.

The use of mirrors to direct a fixture's beam is per se hardly novel. And several fixtures designed or adapted as remote followspots have employed a mirror for beam direction (e.g., the Cyklops and TeleScan).

Mirror beam direction has, however, always had disadvantages, notably on the range of angular beam adjustment possible.

When the included angle between the beam as arriving upon and as reflected from a mirror is reduced, at some point the beam will become folded back into the obstruction posed by the fixture itself.

Figure 2:
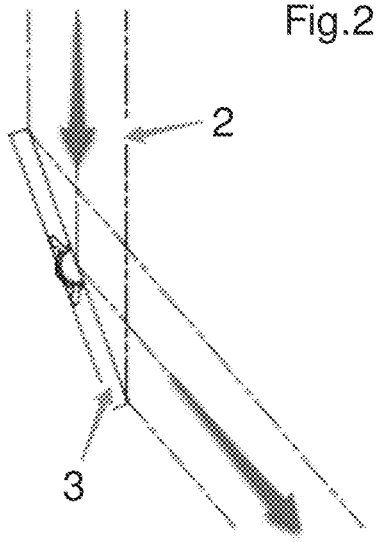
FIG. 2 is a study showing the elongation of a beam at a large included angle between incident and reflected portions.

And, when the included angle is increased, the beam's "footprint" at the reflective surface becomes increasingly ellipsoidal until it elongates beyond the surface's edge. Mirror size can be somewhat increased in the elongating axis, but is ultimately also limited. FIG. 2 is a study of the problem, in which a beam 2 reaches a limit on maximum adjustment despite a mirror 3 far larger than the beam diameter.

Decades of consideration of the problem have produced a variety of beam direction methods employing multiple mirrors, including the applicant's own in U.S. Pat. No. 4,931,916A. Their tradeoff has been the need to move the larger mass of a second mirror, plus its actuator, and their supporting structure. This is a particular problem in the case of existing followspots which, although offering sufficient output for long throws, have beams typically about 8 inches in diameter while requiring fine motion control.

The instant disclosure employs a first, fixed mirror 4 so located that the light beam incident upon it 2*a* is directed generally upwards (as 2*b*), and both beam azimuth and elevation are adjusted by a second mirror 3, which is adjustable in two axes. Beam azimuth is varied by rotating the mirror 3 and twice-reflected beam 2*c* generally around a vertical axis, while beam elevation is varied by tilting/rotating the mirror 3 around a generally horizontal axis.

Many suitable methods are possible.

Figure 3A:
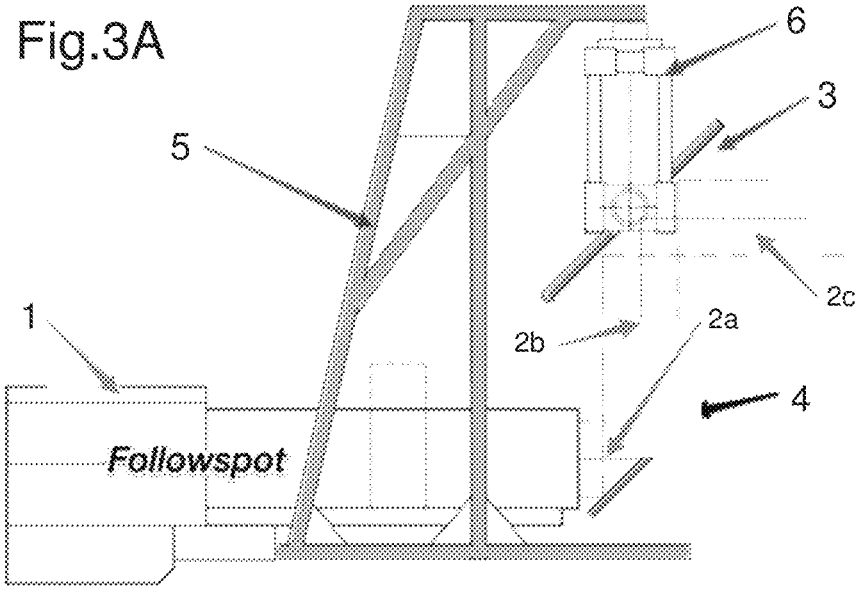
FIG. 3A is a side elevation of a system directing a fixture beam by means of two mirrors, one of which is attached to a two-axis motorized mount.
Figure 3B:
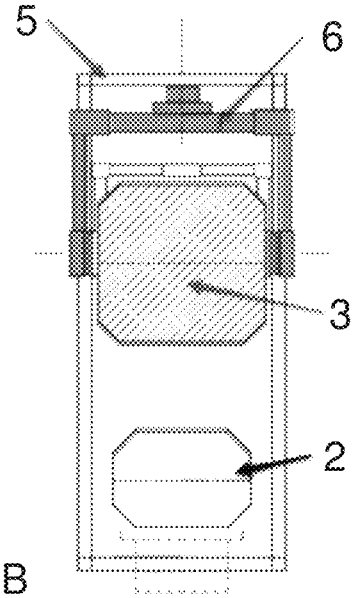
FIG. 3B is a frontal elevation of the system of the prior Figure.

FIGS. 3A and 3B illustrate one possible embodiment.

Mirror direction in this embodiment is provided by a two-axis motorized mount 6 as sold for remote aiming of television and motion picture cameras, by companies such as Mark Roberts, Vinten, Varizoom, and Ross Video; mounts whose power, speed, and precision are more than adequate to the task.

In this embodiment, a mount 6 is supported independently of fixture 1 by a framework or "gantry" 5, which straddles the forward portion of housing 1. First mirror 4 redirects the beam 2*a* as it exits the housing in a generally vertical direction as beam segment 2*b*. The second mirror 3, which is directed by mount 6, is employed for both beam azimuth and elevation adjustment.

Figure 4A:
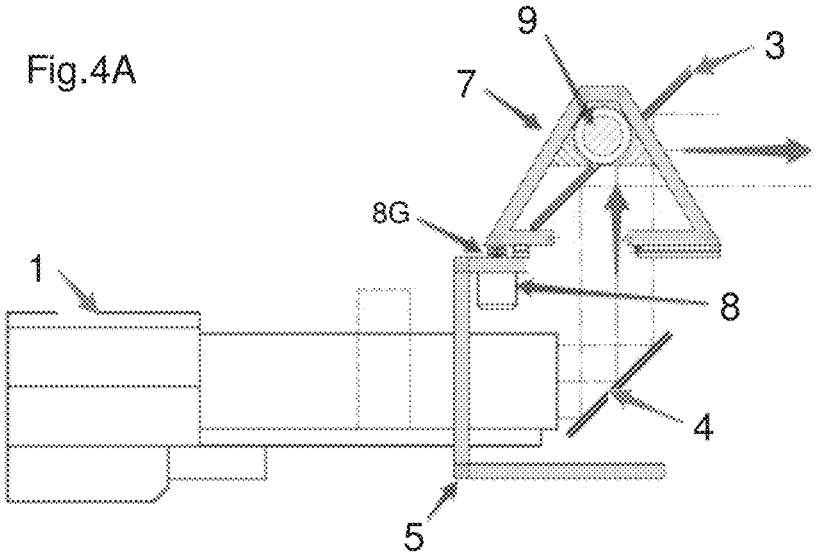
FIG. 4A is a side elevation of a system directing a fixture beam by means of two mirrors, one of which is attached to a rotating turret.
Figure 4B:
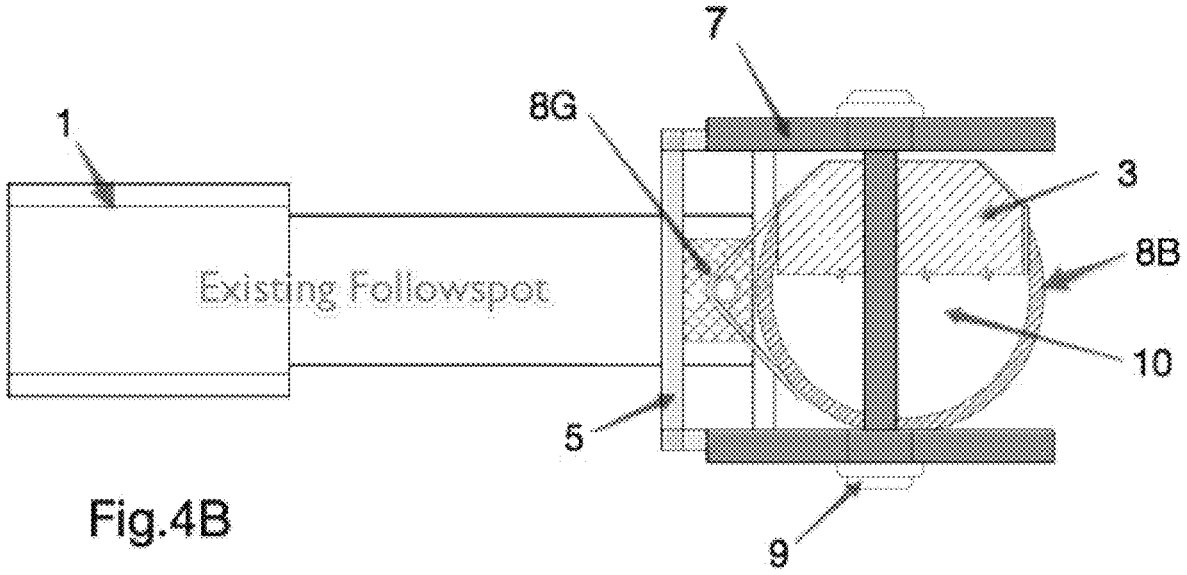
FIG. 4B is a plan view of the system of the prior Figure.

FIGS. 4A and 4B illustrate another possible embodiment.

In this case, gantry 5 supports a "turret" 7, to which is mounted second mirror 3, which is varied in tilt only by actuator 9. Turret 7 is mounted for rotation around a vertical axis on a circular bearing 8B by actuator 8, here using a toothed belt driven by gear 8G. FIG. 4B partially cuts away second mirror 3 to show that the circular opening 10 of bearing 8B allows passage of the beam between first mirror 4 and second mirror 3.

While functional, the embodiments of the prior Figures share with other mirror direction schemes, limits on beam adjustability, including the obstruction of the beam at near vertical "toplight" angles by first mirror 4 and/or by circular bearing 8B.

Figure 5:
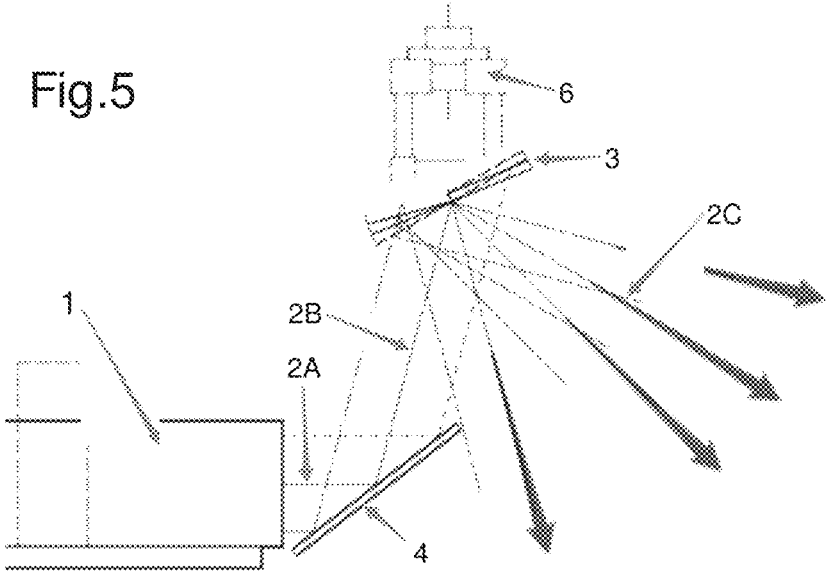
FIG. 5 illustrates the improvement in elevation adjustment and in second mirror size produced by skewing that portion of the beam between the two mirrors off vertical.

Refer next to FIG. 5.

In this embodiment the angle of first mirror 4 is adjusted so as to skew the second beam portion 2*b* off vertical, displacing first mirror 3 forward. This improves the ability of the system to achieve steep vertical angles before obstruction, while second mirror 3 remains of reasonable size.

Figure 6A:
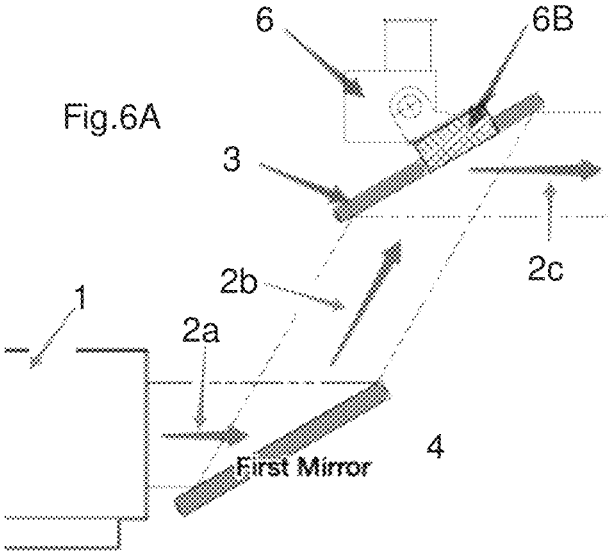
FIGS. 6A and 6B illustrate the improvement in elevation adjustment and in second mirror size produced by skewing the portion of the beam between the two mirrors further off vertical.
Figure 6B:
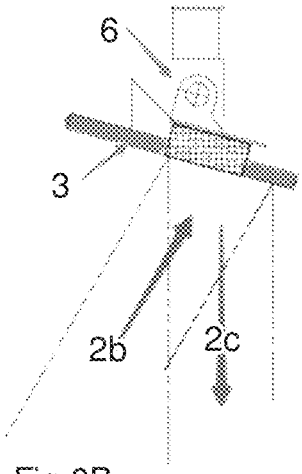

In FIGS. 6A and 6B, the forward displacement of second mirror 3, relative to the first mirror 4, is further increased. The second mirror 3 remains of reasonable size at tilt angles to horizontal (illustrated in FIG. 6A), and yet the system is capable of a vertical beam angle (as illustrated in FIG. 6B).

In these Figures, another, more compact, known type of remote camera mount is illustrated.

Figure 7:
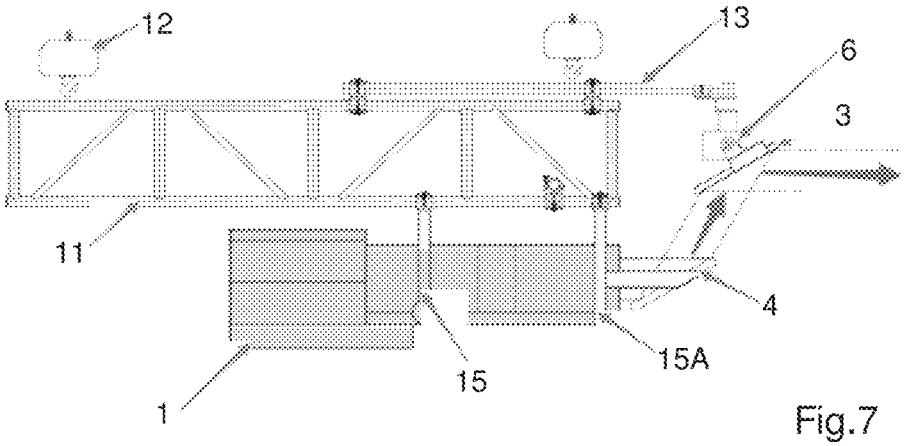
FIG. 7 illustrates one embodiment of a system such as illustrated in the prior Figures being supported by a truss.

FIG. 7 is a side elevation of the system of the prior Figures showing one simple method of support from above. Truss 11 is suspended by chain motors 12. Brackets 15 and 15A suspend housing 1 from the truss 11. Bracket 15A also supports second mirror 4. In this embodiment, pipe 13 and cheseboro clamps provide a support for mount 6, which directs second mirror 3.

Followspots suitable for long throw lighting have housings six or more feet in length, and cannot be safely moved or shipped while installed atop their yokes and stands. They must be disassembled into multiple components for transport, packed into shipping crates or "roadcases". Assembly and reassembly typically require at least four workers.

FIGS. 8A through 8D illustrate how a beam directing system of the present invention can be readily packaged to slash assembly and disassembly time and labor.

Figure 8A:
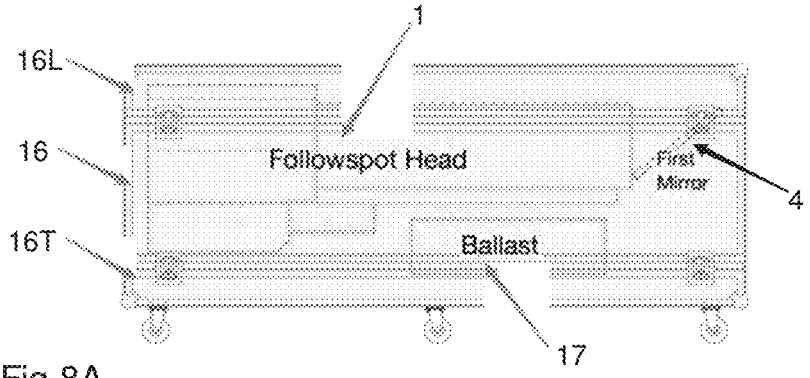
FIG. 8A is a side elevation of a system of the prior Figures as installed for shipping in a "roadcase".
Figure 8B:
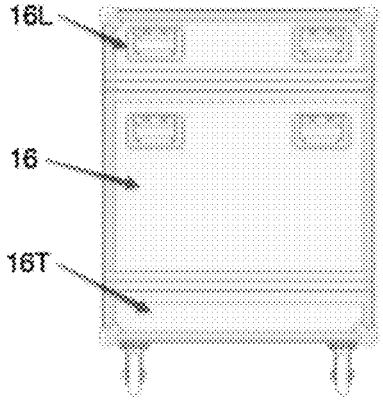
FIG. 8B is an end elevation of the system of the prior Figure in transport.

Referring to FIG. 8A, fixture housing 1 is mounted in a known shipping "roadcase" 16, which is divided into a central portion that encloses the housing 1, first mirror 4, and a known lamp power conditioning "ballast" 17; a removable lid 16L; and a separable portion at the bottom 16T, which allows lifting the central portion off, should access to the housing 1, first mirror 4, or ballast 17 be desired.

Figure 8C:
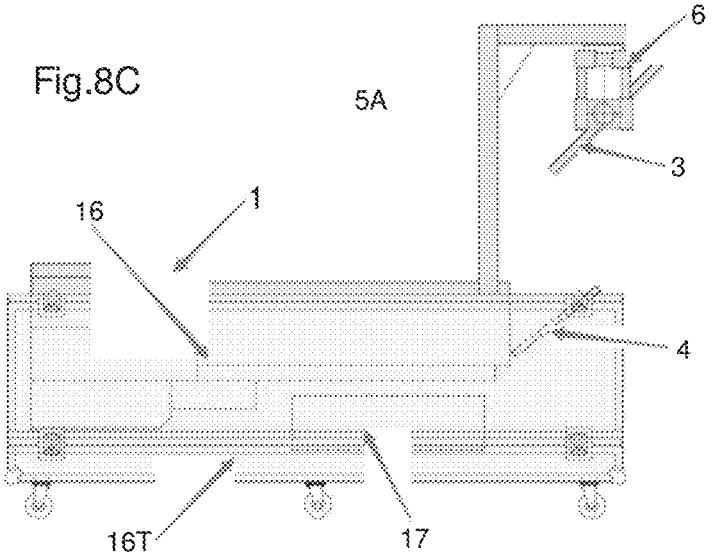
FIG. 8C is a side elevation of a system of the prior Figures when configured for use.
Figure 8D:
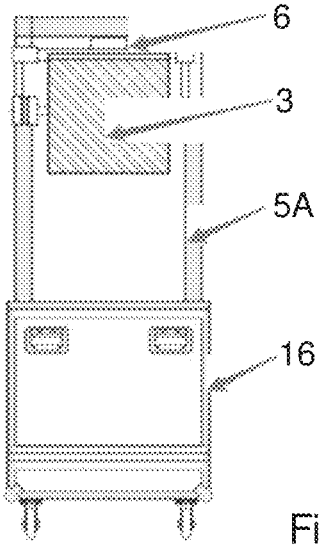
FIG. 8D is an end elevation of the system of the prior Figure.
Figure 9A:
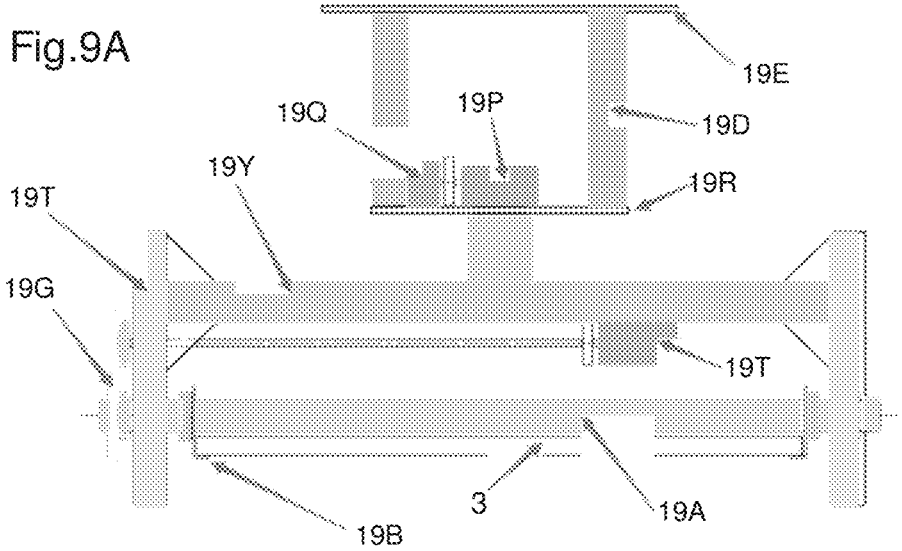
FIG. 9A is a frontal elevation of a two-axis motorized mirror mount.
Figure 9B:
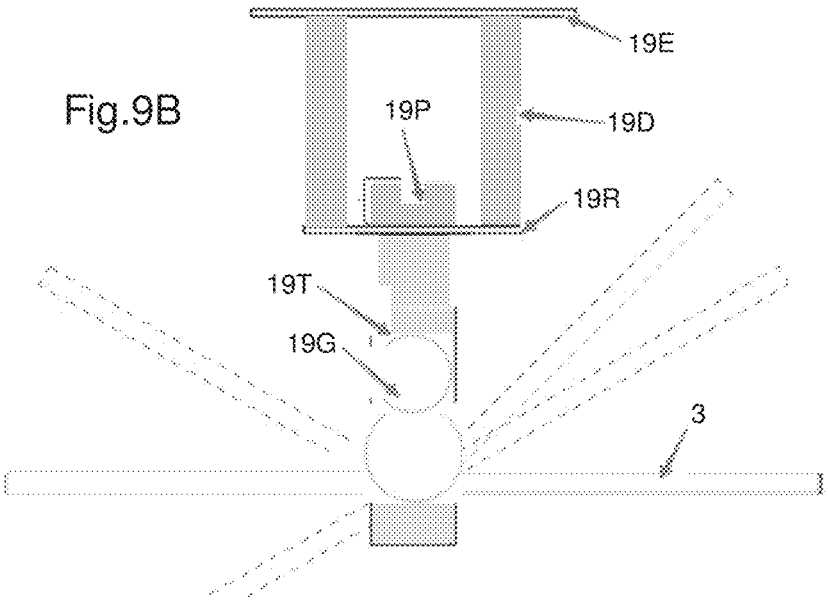
FIG. 9B is a side elevation of the mount of the prior Figure.

Referring to FIGS. 8C and 8D, roadcase 16 is simply rolled to the desired location. Lid 16L is removed and a structural frame 5A (which might be folded up or shipped separately) raises second mirror 3 and its motorized mount 6, above the first mirror, with or without displacement.

The large and heavy housing 1 is never lifted, minimal assembly is required, and the shipping volume of the whole is reduced by elimination of the traditional yoke and stand.

While readily available motorized camera mounts have been illustrated, a purpose built mirror mount can be employed.

Automated lighting pioneer Vari-Lite of Dallas, Tex., in fact, built an outboard remote beam directing mirror mount as the "VLM", disclosed in U.S. Pat. No. 5,590,955A.

FIGS. 9A-9E illustrate one embodiment of a motorized mirror mount.

Referring to the Figures, it will be seen that the modest range of tilt angle required by the system permits shortening the arms 19T of yoke 19Y supporting mirror 3, reducing volume and increasing the stiffness of the structure. Brackets 19B support the mirror 3 from a tubular axle 19A, which is driven via a gear system 19G, by a tilt actuator 19T. The yoke 19Y is supported by a pan bearing 19P driven by actuator 19Q, mounted to plate 19R. Extruded "pillars" (e.g., 19D) connect plate 19R with plate 19E, which is used in mounting the assembly to a larger structure by any suitable means. A volume is defined within the plates 19D and 19R and the "pillars" 19D in which electronics can be housed.

Use of a first mirror that "tips" the beam up to the steering mirror has several additional advantages beyond a wide range of angular adjustment in useful ranges with minimal mass to move.

Many discharge lamp types have limits on their operating orientation. Followspots of the class necessary are designed both around lamps and thermally for substantially horizontal operation, which the disclosed system maintains, while also securing the advantages of a vertical or off-vertical incident angle on the steering mirror. Substantially horizontal housing orientation minimizes fixture profile, whether suspended or ground supported. It allows shipping, supporting, and suspending a fixture with a minimum of lifting or handling between modes.

That said, fixtures can be designed or adapted for use in other orientations, as well as for folding the optical path, to reduce overall size and/or produce the desired incident angle on the steering mirror.

One application for a substantially vertical fixture mounting (and requiring only a single, pointing mirror) is the mounting of such fixtures on substantially vertical truss "delay" towers as used in large outdoor events to support additional, supplementary loudspeakers at a distance from the stage and main sound system on it. One or more vertically-oriented fixture can be mounted on the stage side of the truss tower to produce a lighting position that is closer to the subject than are positions in the permanent seating beyond—yet with no additional obstruction of spectators' sightlines to the stage with its a resulting loss of revenue.

The distance between the fixture and the steering mirror can be made variable and/or substantial to "lift" the aimed beam above obstructions, for example, when there are seated patrons between a fixture position and the subject. The geometry of one or more reflective surface can be made non-planar to have a beam-forming/optical function.

When a camera with a field of view aligned with the beam is used in aiming, it can be located prior to the pointing mirror so that its field of view remains aligned with the beam.

Sharing Subject Location Between Lights and Cameras

As discussed in the prior related application, systems are known in which beam azimuth and elevation adjustments are driven not by entry of corresponding values (either by an operator using a manual control or as pulled from data storage), but by means of a subject/target location ("focus point") expressed in a 3D coordinate system (with an implied or specified "Z" or vertical/altitude axis).

Working from the location of each fixture in the 3D space, individual azimuth and elevation values for each fixture's beam direction are then calculated to intersect the target's coordinates.

In a prior disclosure, a manually steered fixture, whether attended or remote, is aimed by an operator, and its subject's/target's location is calculated from the stream of values generated by the operator's aiming. Working with the 3D location of the fixture (or other device) aimed, coordinates are calculated, and calculated target location is then used as the basis to compute intersecting beam adjustments by other fixtures.

It is a further object of the disclosure to share aiming data across the boundary between lighting fixtures and cameras used in the same project.

In arenas, stadiums, and other large venues, there is extensive use of "videomag" or "i-mag" (video/image magnification). Multiple television cameras are used to capture close-ups of talent, which are presented on large video screens for the benefit of distant spectators.

As such "i-mag" services have evolved, productions tour with roadcased control rooms and packages of six to twelve cameras, including "ped" cameras on tripods from distant positions with long lenses; handhelds used on and in front of the stage; known "jib", dolly, and tower cameras; and remote (or "robocam") cameras that can be stationed onstage with a remoted operator. Such cameras require operators, who sometimes must be drawn from semiskilled or unskilled labor.

Because most of the camera work is on the same performers/subjects also being lit by fixtures manually or automatically steered to follow them, treating the performers/subjects as objects having coordinates in space and sharing those coordinates among remotely controlled lighting fixtures and cameras allows slashing the number of total workers required and improving quality and consistency.

In one embodiment, a control room worker can switch directional control of any camera or combination of cameras to the coordinates generated by a manually steered lighting fixture, a talent tracking system, or a scenic or rigging motion control system locating the talent in space. Conversely, the lighting side can chose to take location data generated from a television camera, whether attended or remote, whose aim and location are used to derive subject location, whether from just its streaming data or by triangulation using other cameras/operators/inputs.

3D mapping of subjects and cameras allows calculating distances between cameras and subjects, assuring automatic focus correction, including under conditions with no light onstage.

Parameter Compensation for Varying Throw

In regards the distance (or "throw") between a lighting fixture and a subject lit, the prior related application describes determining the distance between the two or "throw" and using that value to automatically compensate beam parameters such as size and intensity to maintain substantially constant (or otherwise desired) absolute values despite substantial changes in such distance caused my changes in the subject lit and/or the subject lit's movements.

Providing this capability can be simplified by using the fact that beam rotation about the vertical pan axis of a fixture will describe a cone having the fixture at its tip/top and the beam trace a diameter at its base, where the beam intersects a generally horizontal ground plane or surface on which the subject/target is found.

The surface of this cone describes a series of radials/distances between the tip/point/fixture and the ground plane—of "throws"—all being of equal length.

Changes in fixture tilt/beam elevation will alter the slope of the cone and the diameter of the circle described at the ground plane, the beam path included. While it is not immediately possible to quantify that distance in feet or meters at any given tilt/elevation/slope without knowing the height of the fixture/tip above the ground plane, the relative difference between the distances produced at various tilt angles/cone slopes can readily be calculated from the difference in tilt/elevation angles alone. Because the size of the beam varies proportionately with distance and its brightness with the square, the relative change in both parameters can be predicted, based only on tilt/elevation (and compensated for) without need of determining the actual height of the fixture above the ground plane or its location relative to a subject.

Tilt angle can be determined from fixture (or mirror) angle, for example by an absolute encoder or as generated within a motion control system.

Alternatively, a tilt sensor or inclinometer can be used which references true vertical. This will account for the fixture being hung out of plumb (which can introduce errors and deviations), as well as for applications where the fixture is attached to a supporting structure which itself changes its angular relationship to the ground plane, for example, when it is tilted on one or more axis for visual effect.

An Improved LED Retrofit to PAR 64 Fixtures

Another fixture type long in use is the "PAR can".

Figure 11A:
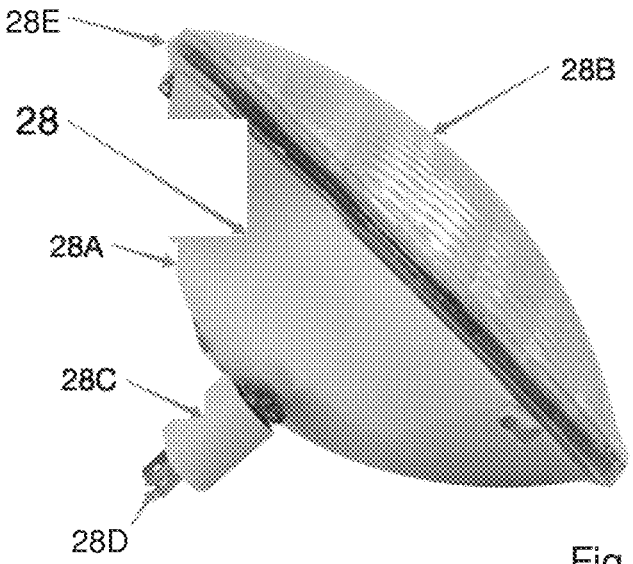
FIG. 11A is a side view of a PAR 64 lamp.
Figure 11B:
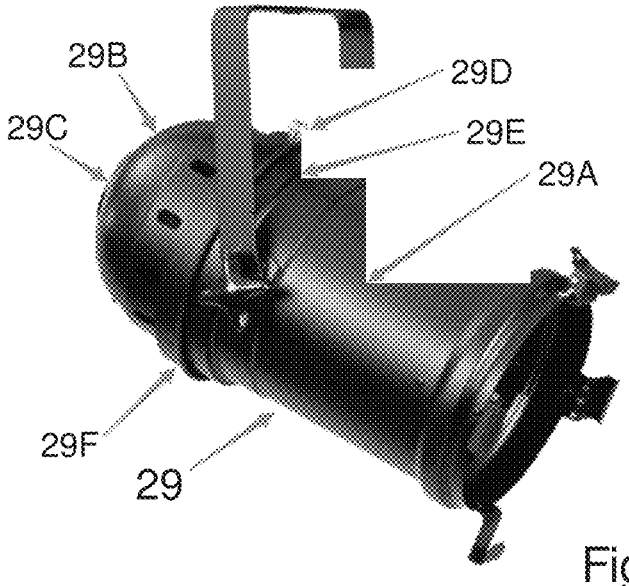
FIG. 11B is a side view of a prior art fixture for the PAR 64 lamp.
Figure 11C:
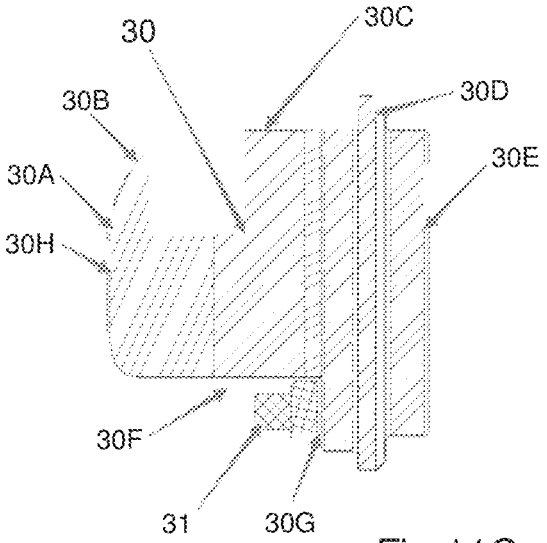
FIG. 11C is a side view of one embodiment of an LED replacement for the PAR 64 lamp.
Figure 11D:
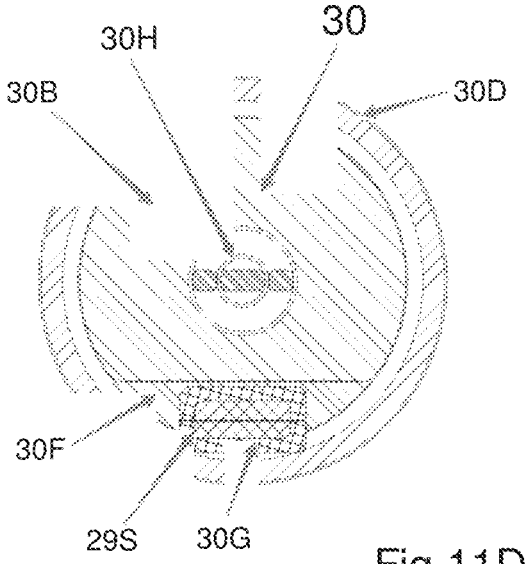
FIG. 11D is a rear view of the lamp replacement of the prior Figures.

Evolved out of sealed beam automotive headlamps, the "PAR" (Parabolic Aluminized Reflector) lamp (a 1000 watt example seen in FIG. 11A) integrates filament, reflector, and lens in a single molded glass envelope. Finding extensive use in industrial and architectural applications, PAR lamps in various diameters and wattages were also adopted for performance, film, and television lighting. The early 1970s saw their adoption as the near universal solution for lighting touring concerts, from which their use in other forms of event further spread. High output, light weight, ruggedness, and economy were their appeal. The physical structures used to support (and transport) lighting fixtures in these applications (such as "lamp bars" and "pre-rig" trusses) were designed around the PAR 64 fixture, typically of the spun aluminum design seen in FIG. 11B.

With the passage of time, LED technology has become suitable for some PAR applications. New fixture designs using LEDs have been offered. It is an object to disclose improved packages for retrofitting LED technology to existing PAR fixtures and, thereby, extend the useful life of the very efficient structures (such as "pre-rig" truss) that had been designed around them.

Refer now to FIGS. 11C-11F, where one such package is shown.

Packaging LED emitters, per se, within the form of the traditional halogen PAR envelope is possible, but the value of such substitution would be markedly increased by the capability to vary beam characteristics such as size, shape, edge sharpness, and the orientation of non-circular beam shapes. This requires more depth than the standard PAR envelope allows.

The improved package illustrated in the Figures provides additional depth and volume by making better use of the volume available in the prior art PAR 64 fixture.

Such fixtures 29 include a barrel 29A, at the rear of which a shoulder or flange 29E receives the rim 28E of the lamp 28, which is retained there by a sprung ring.

Rear cap 29B covers the reflectorized portion 28A of the lamp's envelope, from which project two prongs 28D for electrical connections, by means of a socket 29S wired, via the rear cap, to a line cord with suitable connector. An opening 29C is provided in the rear cap 29B to access the socket 29S, which is grasped and rotated to change the orientation of the lamp's beam, which, in most bulb types, is elongated in one axis.

As seen in the Figures, the improved package extends well into the volume afforded by rear cap 29B. Further, where manual controls 30H are offered for beam adjustment, they are located on the rear face 30A of package 30, so as to be visible and accessible through the existing opening 29C in rear cap 29B. Electrical rework of the existing fixture 29 is eliminated by reuse of the same wiring, including socket 29S, which is offset towards the rim of the package to maximize internal volume for optics and into a "carve out" 30F of the overall shape for this purpose, and to allow for the volume required within rear cap 29B for the entry of the line cord and its connections to the leads of socket 29S.

Figure 11E:
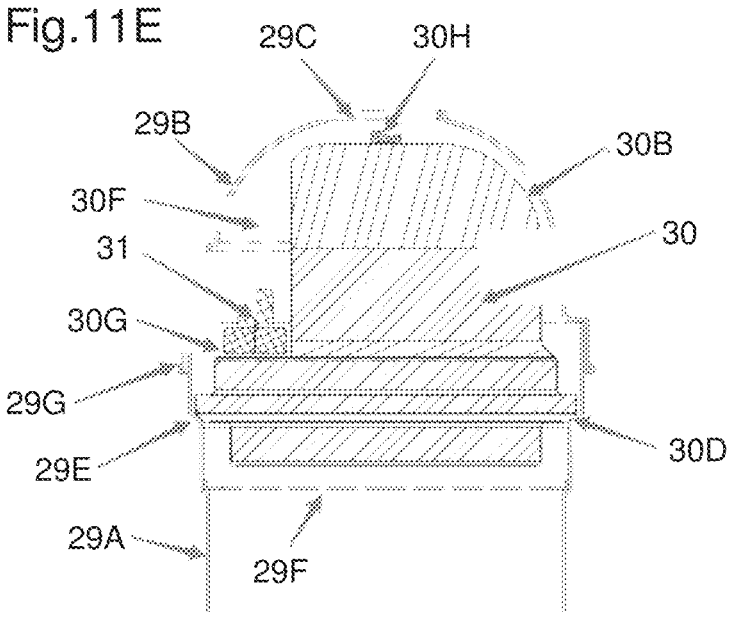
FIG. 11E is a section through a PAR 64 fixture with a top view of the lamp replacement of the prior Figures installed.
Figure 11F:
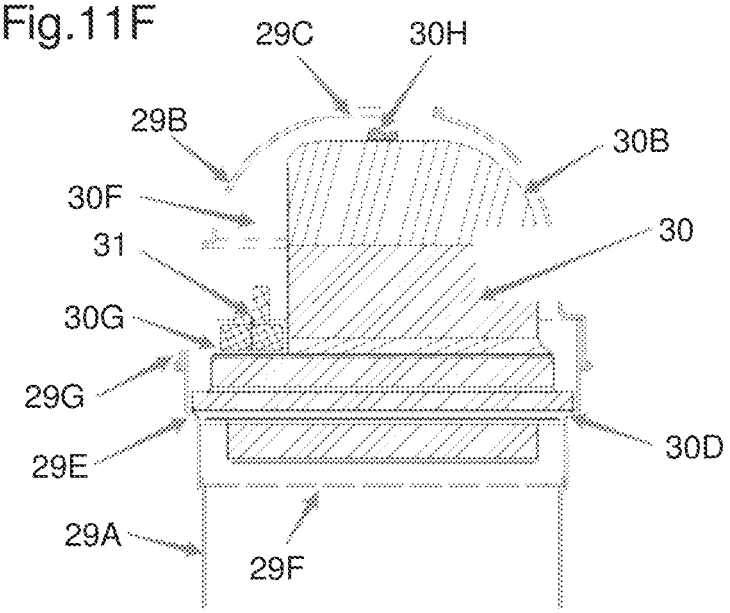
FIG. 11F is a section through a PAR 64 fixture with a side view of the lamp replacement of the prior Figures installed.
Figure 11G:
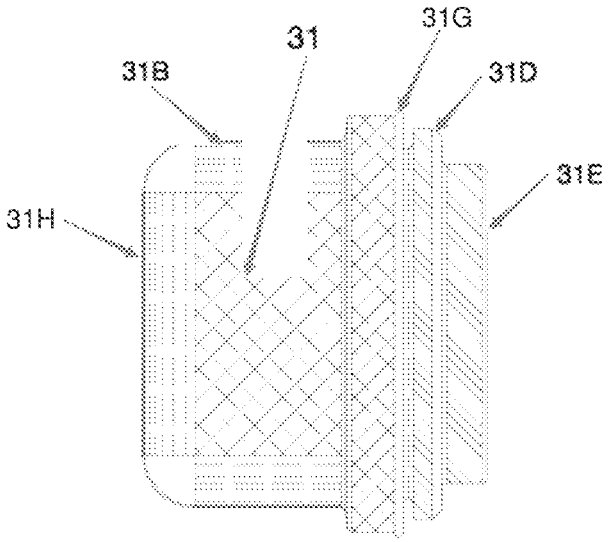
FIG. 11G is a side view of another embodiment of a replacement unit for PAR 64 fixtures.
Figure 11H:
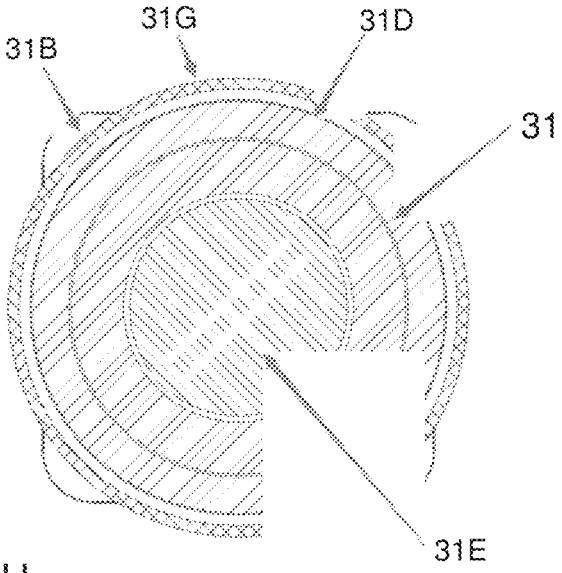
FIG. 11H is a front view of the replacement unit of the prior Figure.

Both disclosed packages also gain depth by extending forward of the seating feature 29E, ultimately limited by safety screen 29F, which is provided in such fixtures to stop larger fragments, should the glass PAR envelope shatter.

Where still more volume is desired, including external surfaces for power and data connectors, controls, and displays, FIGS. 11G and 11H illustrate an embodiment that replaces rear cap 29B in its entirety.

Referring to FIGS. 11E and 11F, it will be seen that the engagement between rear cap 29B and barrel 29A is at mating combination of the rear edge of barrel 29A and a flange 29G formed in the rear cap 29B. The two are held together by a latch 29D and a stud 29F that extend through aligned pass holes.

Removal of rear cap 29B (which is afforded for lamp changes and to replace wiring) leaves barrel 29A available to receive a physically compatible new unit 31, which contains the LED source and its associated components. A larger and more rectangular package provides increased volume, as well as ample surface area for connectors, controls, and displays. The new unit engages barrel 29A by means of its own flange 31G, and can be retained by the same features 29D and 29F on the fixture.

A Twist-Lock Connector

Also described in prior related applications are various improvements to the distribution of power and data to lighting fixtures and other consumers.

The "twist-lock" connector has long been in industrial and entertainment lighting use. Starting in the 1980s, with the uptake of generic "moving lights" operated on 208 volts (derived by connecting across two phases of a three phase 120/208v North American alternating current supply), a connector was needed not intermateable with those being employed for 120 volt service. Models of the "twist-lock" connector specifically intended for such 208v applications came readily to hand, and the NEMA L6-20 configuration became a defacto U.S. standard (except for some companies, who chose the 15A version).

Purportedly, the "twist-lock" offered the advantage over the 120v connectors in common entertainment use, that a mated pair could be locked together by counter-rotating them. But, as described in the prior application, this is not reliably the case, either for failure of the user to rotate the connector set to the locking relationship, or by the application of torque to the connector set, typically via the cable(s), that rotates the set to unlocked.

It remains desirable that a method be found of assuring that a "twist-lock" connector set be maintained in a locked condition.

Several methods are disclosed in the prior related application.

Further disclosed herein is an approach described in the prior application, in which at least one feature projects from the face of one or the other of the male or female connector.

When the blades of the male connector enter the female, upon reaching full insertion, the user should then rotate the two relative to each other in order to lock. The projecting feature, on first insertion, reaches a surface on the other connector. Rotation towards the correct angular relationship for locking "travels" the projecting feature of one connector across the surface of the other until it reaches a receiving feature, such as a well or indentation on that other connector, into which the projecting feature is urged, typically by a spring.

In effect, a drawbolt is shot, which will prevent the connector set from being rotated back towards an angular relationship in which the blades can be withdrawn. Only when a user overcomes the sprung force urging the projecting feature on one connector into the receiving feature on the other, such that the projecting feature is withdrawn sufficiently to permit rotation, can the connector set be unmated.

In the prior disclosure, one disclosed embodiment made use of the presence of potential receiving features available on existing connectors, such as the wells countersinking the heads of screws used to assemble the connector.

Disclosed herein is another embodiment independent of the presence, size, location, or depth of any features that might be present in a given brand of connector—and might differ one to another brand or model.

Illustrated here is the projecting feature on a male plug body.

In FIGS. 10A-10E it will be seen that, although the projecting feature (here, "plunger" 24) could be designed to engage a receiving feature present on the mating connector (for example, the previously described recesses for screws and/or feature(s) incorporated for the purpose), this embodiment makes use of at least one opening 300 provided in the female connector 30 to admit the entry of the plug's blades.

Figure 10A:
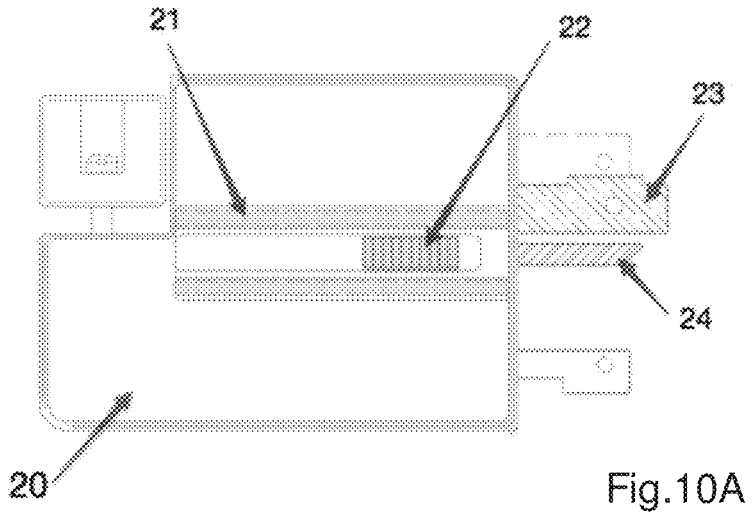
FIG. 10A is a side elevation of an improved twist lock connector.
Figure 10B:
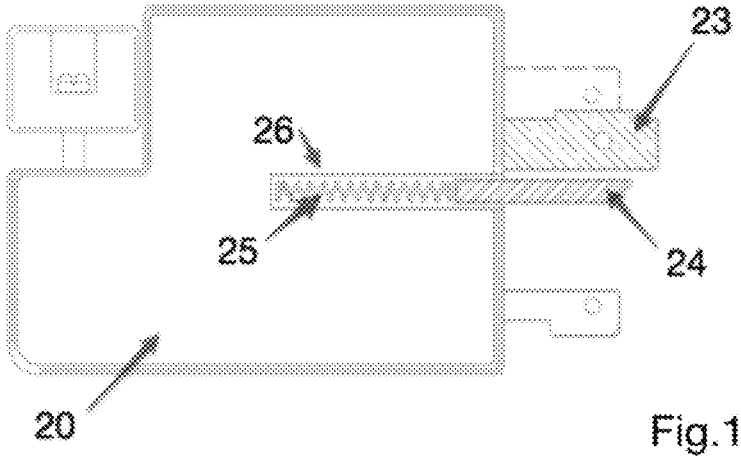
FIG. 10B is a sectional view of the improved twist lock connector from the same perspective as the prior Figure.
Figure 10C:
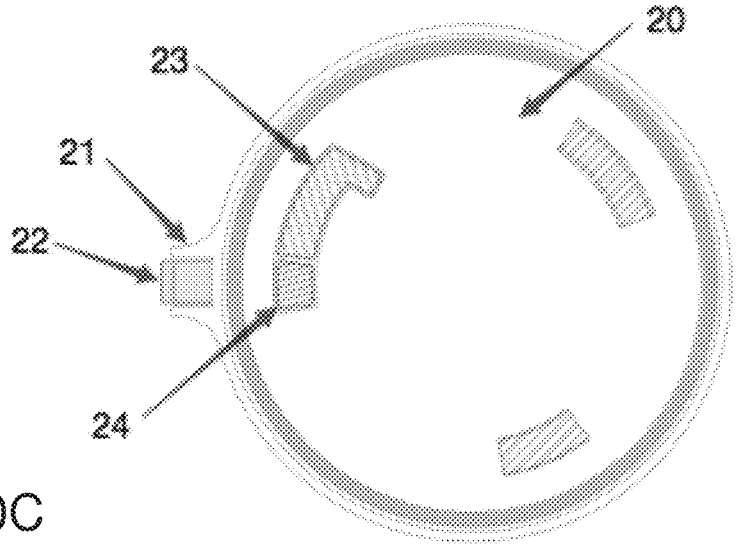
FIG. 10C is an end view of the improved twist lock connector of the prior Figures.
Figure 10D:
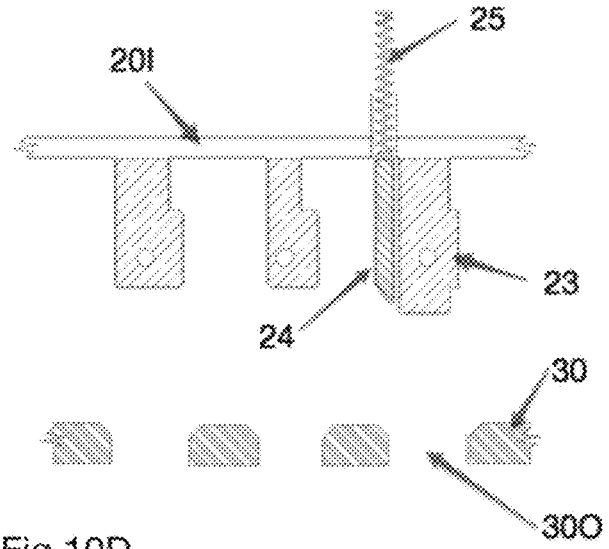
FIG. 10D is a section of the improved twist lock connector of the prior Figures and a receptacle before mating.
Figure 10E:
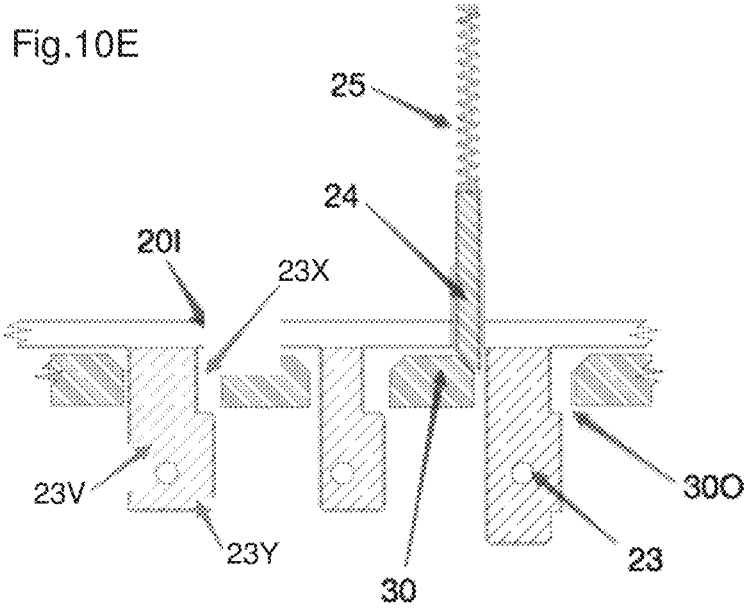
FIG. 10E is a section of the improved twist lock connector of the prior Figures and a receptacle during mating.
Figure 10F:
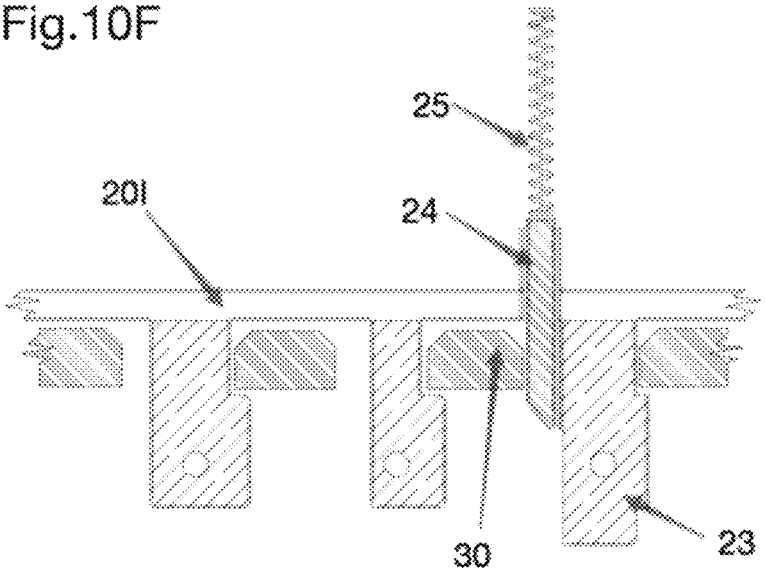
FIG. 10F is a section of the improved twist lock connector of the prior Figures and a receptacle after mating.

For the "twist-lock" connector to lock, at least one blade (for example, blade 23V of FIG. 10E) must have a forward portion (e.g., 23Y) that extends around a greater radial range than that portion of the same blade closer to the connector body (e.g., 23X). The setback where the blade narrows, when rotated behind the face of the receptacle, prevents un-plugging. In rotating the connectors from an insertion/withdrawal axial relationship to a locking one (as is illustrated in FIG. 10F) in the following figures, a space (e.g., 23Z) is produced in the opening 300 in the receptacle face 30 that had previously been necessary for insertion of the full width of the blade (in this example, 23V). It is into this "revealed" space that the projecting detail/"plunger" 24 is urged.

Disconnecting the mated connector pair requires manually overcoming the force (here, spring 25) that urges the projecting feature into the receiving feature, withdrawing the former sufficiently clear of the latter to permit rotation.

In the prior figures an externally available tab 22 is shown for the user to draw back the plunger, here protected against damage and accidental displacement by protrusions 21 formed in the plug body (which also serve as visible and tactile references in orienting the plug about its central axis).

Although the projecting feature is here illustrated on the male side of the connector set, it will be understood that similar techniques can put the mechanism on the female side.

Improvements to Leg Carriage Type Trusses

In submissions during the prosecution of related applications, the applicant has provided an extensive history of the evolution of "truss" structures used to support lights and other loads for many kinds of performance and event.

"Pre-rig" truss designs allow shipping truss sections with fixtures already installed and largely pre-wired. The advent of automated or "moving" lights prompted the search for a suitable pre-rig design for them, examples of which began appearing in 1987.

Introduced in 2008, the Tyler "GT" design, as disclosed in U.S. Pat. No. 8,099,913 B1 to Dodd, has become the standard of the U.S. lighting industry. It has, however, a number of defects that complicate its operation, costing time and labor.

Prior related applications disclose a number of improvements intended to address these issues, both in retrofit to existing inventories of the GT truss and in new construction of the GT and of other designs.

Figure 12A:
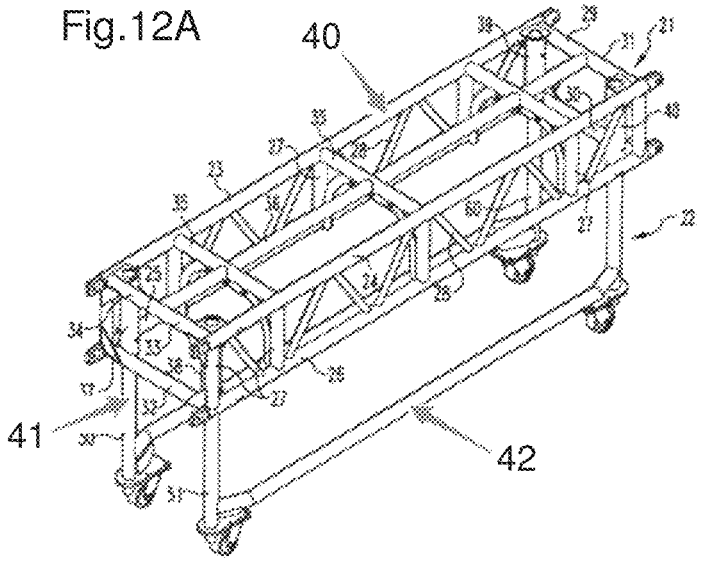
FIG. 12A is a general view of the Tyler "GT" leg carriage truss as disclosed by Dodd.

Referring to FIG. 12A, which is FIG. 1 of Dodd, the truss proper 40, provides four elongated chords (23, 24, 25, and 26) that form a rectangular volume between two ends having fittings that permit endwise joining of multiple sections to form a longer span. Cross members (e.g., 35 and 27) connect the chords on three sides. A central member 36 is provided for attachment of fixtures and other loads, which, as illustrated in FIG. 10 of Dodd, can protrude out the fourth, substantially open side, such that their beams can be adjusted through a wide range of angles without obstruction.

Figure 12B:
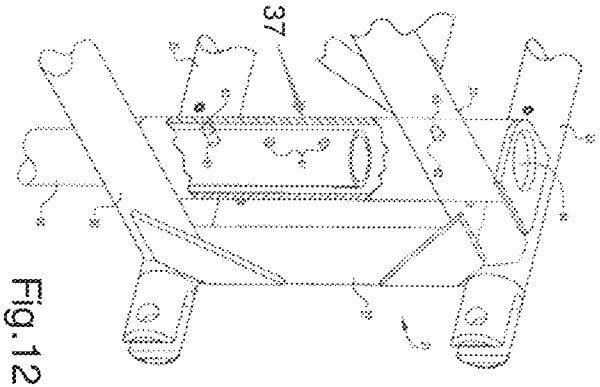
FIG. 12B is a detail showing the engagement of the leg with a sleeve in the truss.

To permit transport of the truss sections with fixtures so protruding, leg carriages 41 and 42 are provided, each having two vertical legs (e.g., leg 50) which are received into tubular sleeves (e.g., 37) located in corners of truss 40, as shown in FIG. 12B, which is Dodd FIG. 5.

Carriage legs are fixed to the sleeves using locking pins extending through aligned pass holes in both sleeve and leg, supporting the truss and the exposed portion of its fixtures on casters (Dodd FIG. 11) for transport.

Unlike some other schemes in which a truss having portions of fixtures extending beyond its envelope rests atop a castered frame for transport, the Dodd design requires that the legs be inserted a substantial distance into the sleeves in the truss itself.

Figure 12C:
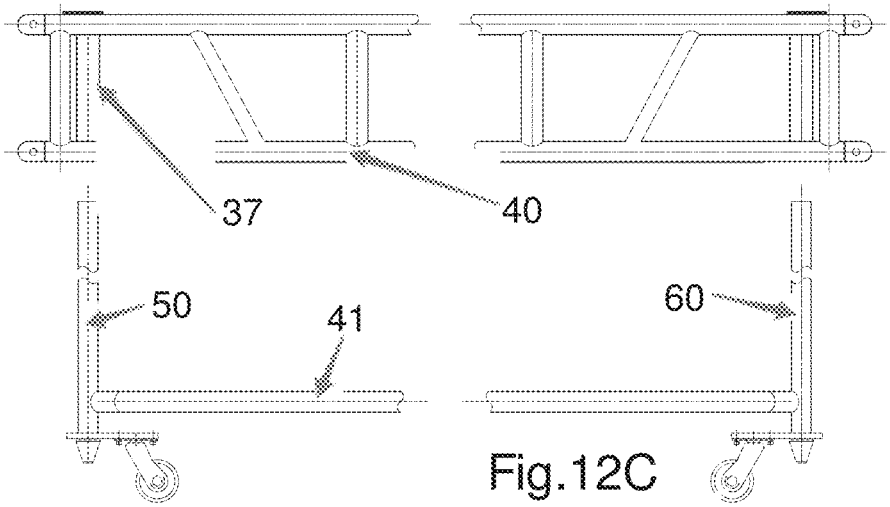
FIG. 12C is a side elevation of the truss and leg carriage of the prior Figures.
Figure 12D:
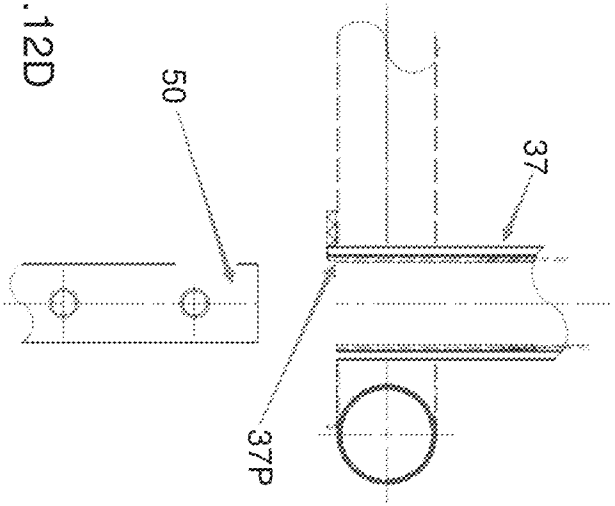
FIG. 12D is a section showing the leg, sleeve, and plastic liner of the first generation of such trusses.

As seen in FIG. 12D, as initially designed and produced, the leg 50 was of a 2" outer diameter and the sleeve 37 an approximately 2.4" inner diameter, with a plastic material 37P applied to the sleeve to reduce friction.

Figure 12E:
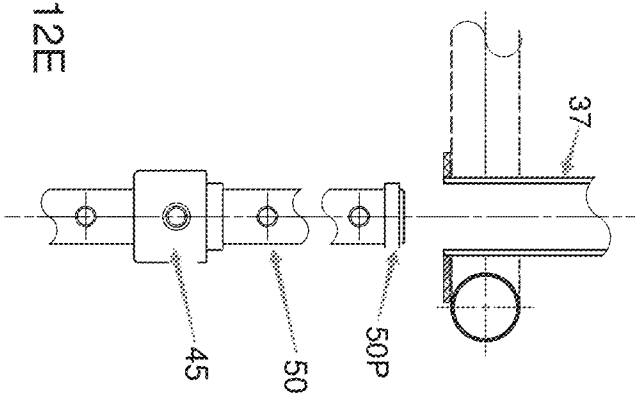
FIG. 12E is a section showing the subsequent modifications intended to reduce leg binding.
Figure 12F:
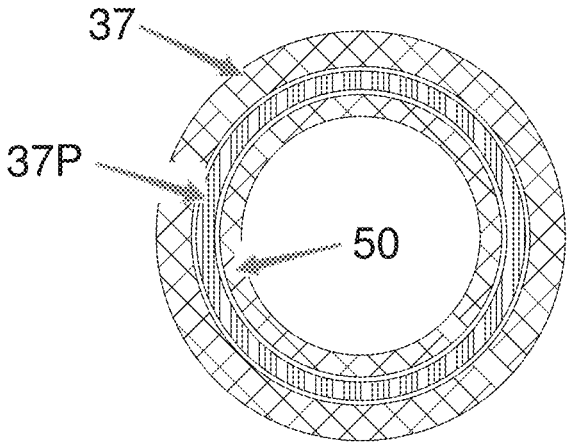
FIG. 12F is a section through either generation showing the leg, sleeve, and intermediate plastic part.

FIG. 12F is a section through the sleeve with a leg inserted.

FIG. 12C is a side elevation showing the leg carriage 41 in operative relationship with truss 40. Two workers are required to insert or remove the legs 50 and 60 of carriage 41 from the sleeves of truss 40. Should both workers maintain the leg carriage level during insertion and bring the correct corresponding hole 61 in each of legs 50 and 60 into alignment with the lower pass hole in sleeve 37, then the leg carriage 41 will be correctly installed.

However, the tolerances between the diameters of leg 50 and the plastic liner 37P in the sleeve are generous enough that, over the span of a leg carriage, pass holes at different points on the two legs can still align with the pass holes in the sleeves and the leg carriage be pinned at different heights at the ends, which will not permit disconnecting sections from each other or safe transport.

A larger failure of the workers at either end of the same leg carriage to match their movements, in either insertion or removal, will effectively increase the diameter of the leg in the elongated axis of the carriage, sufficiently to cause one or both legs to bind. Time and force are required to "unstick" the leg and resume work.

To address binding, the "GT" design was modified as seen in FIG. 12E. The plastic insert 37P was removed from the sleeve 37 and a small ring of it 50P attached at the top of the leg 50. Because this resulted in excess play lower down in the leg, a molded collar 45 was designed. Doubling as a mechanical stop to limit leg insertion, the upper portion of collar 45 shims out the gap between leg 50 and sleeve 37.

While reducing binding, the revised design added several new problems.

In prior disclosure, the applicant illustrated several improvements to address binding, including in FIG. 51C, in which multiple, tapered rings around the leg remove the need for a fitting set at the bottom of sleeve 37.

The applicant also teaches that the relaxation of tolerances between the leg portion inserted in the sleeve and the sleeve can itself, address the binding problem. As the weight of the truss and its loads bears on the retaining pins during transport, the fit between the legs and sleeves at opposite ends of the same leg carriage have no impact on stability.

This use of asymmetrical clearances between elongated leg carriage axis versus perpendicular to it can be produced by many means.

Figure 12G:
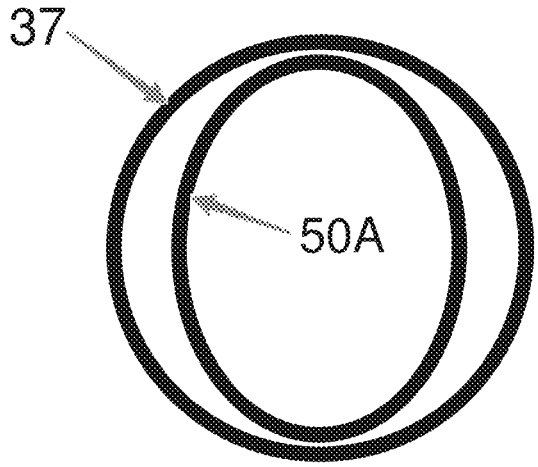
FIG. 12G is a section showing increased clearance in the elongated axis of the leg carriage to reduce binding, here by use of an ovoid leg.

One method, illustrated in FIG. 12G, is to use an ovoid shape or one having flattened faces on the elongated axis. This method can be used with existing or new truss sections having round sleeves.

Figure 12H:
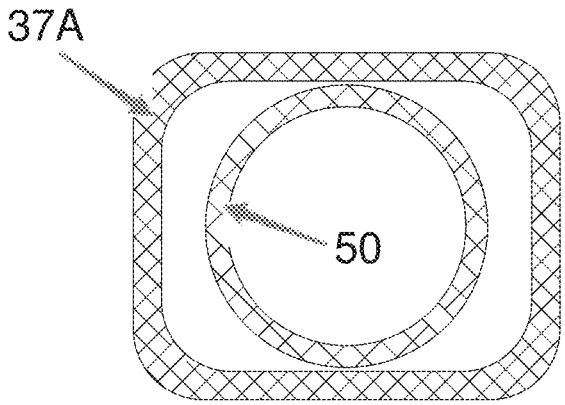
FIG. 12H is a section showing increased clearance in the elongated axis of the leg carriage to reduce binding, here by use of an elongated sleeve.

Another method, illustrated in FIG. 12H, is to produce the increased clearance despite a round leg by elongating the shape of the sleeve.

An Improved Credentialing System

In a prior related application, problems in controlling access to venues and other spaces are described, including in the generation of and quick access to accurate and current databases of those persons authorized to enter, as well as the subset allowed access to more secure areas within it (e.g., a stage, dressing rooms, VIP area); including as limited by time period or activity (day, shift, purpose, etc.), and permitted behaviors (photo-taking, escorting others without the required credential).

Access control employs a range of physical credentials, issued in various forms (laminated cards, "stickies"/self-adhesive patches, wristbands). The type of credential issued, as well as variations in its shape, size, color, and graphic design, are all used in differentiating classes of clearance in a manner visible to security personnel and other staff.

At access control points, security personnel "eyeball" those persons approaching, looking for a visible such credential and mentally comparing its design with their brief as to which credential types/classes are to be permitted passage. This task is often made more difficult by the number of persons simultaneously seeking passage, and by environmental conditions, such as low light and loud music, that hamper visual inspection and make verbal communication difficult. Less than careful scrutiny allows the passage of those who do not belong in a secure area. But time-consuming inspections, including by channeling persons through choke points, constrict traffic flow and produce undesirable crowding and delays.

Recently, RFID tagging has been added to some credentials. In some circumstances, like turnstiles or doorway locks, the user holds the RFID credential close to a reader. On detecting an appropriate code, passage is permitted.

While, in principle, the human element of visual inspection for a credential is removed, various problems limit the application of such technology.

Near field systems, in which the user is required to hold an RFID tag to a reader, require constricting traffic flow to "gate" persons serially past the reader. Although RFID technologies are available that permit reads at greater distances, such reads simply detect that a tag is in range, but cannot, themselves, identify the wearer. Thus, if ten people approach an access control point, a longer-range reader fails to identify which ones have a valid credential.

RFID systems, especially at longer ranges, are also not without sources of potential error and interference.

The applicant discloses improved methods of quickly identifying authorized persons by visual inspection from a distance, one far faster, simpler, and more reliable than current credentialing methods.

In one embodiment, an "active credential" is produced, which receives an input such as by light or another stimulant and responds to detection with a visual signal, such as by lighting an onboard LED.

Such an "active credential" can come in many forms, such as a button, a wristband, a tag, a lanyard, or a frame for a credential. It can be battery powered.

Another component of the system can be a separate "emitter" which radiates an emission that the active credential can detect. The "emitter" may take many physical forms, such as one similar to a smoke detector. Can be mounted on a wall or supported on a stand. Emitters can also be designed to be worn by security personnel and others, such that in facing the would-be entrant, the emitter is aligned with them.

In one simple embodiment, the mere detection by the active credential of such an emission triggers it to visual indication.

In one example, persons approaching an access control point, wearing active credentials, will have those credentials triggered to indication by an emitter at that control point. Security personnel need only look for illuminated active credentials, allowing passage by those wearing them.

Importantly, the character of the emission can be varied and the active credential configured to respond to (as desired) some subset of a plurality of possible emissions.

Thus, the emitter at a given location that is restricted to persons with a specific access requirement/class (for example, a VIP area) can produce emissions including a unique characteristic that only those active credentials issued to persons cleared for such class (e.g., VIP access) will respond to (although the credential might also respond to other emissions at lower classes or for other areas or purposes). Responses to different emissions may differ in visible characteristics such as color and/or patterns or sequences of illumination, which assists security personal and other staff in confirming the access authority of the wearer.

A near unlimited number of possible codes/characteristics allow differentiating levels and windows of permitted access, and an active credential can be determined to respond to any combination of them.

Thus, extensive and specific control over access can be enforced, while the performance demanded of security personnel is reduced to simply allowing passage by those whose credentials visibly indicate correctly and denying it to those whose credentials do not.

Credentials can be programmed at issue with access authorities for the wearer issued it. Many methods are possible. One is magnetic coupling, which can also be used for transmitting charging current. A photocell can be used in charging as well as in programming.

Credentials can generate emissions, either using a visual indicator or by other means and for additional or other purposes. For example, visible (or not-visible) light can encode data, such as a user ID, which permits uniquely identifying the credential itself, which will often have been pre-associated in a database with the wearer's name and other data.

A local RFID emission at an access point can be used as the credential triggering emission, as well as for prompting return of an RFID code in the known manner that identifies a person as being in the proximity, for example for logging and uploading such data to locate and time stamp the person—while also offering a visible indication to allow a worker to pinpoint the credential responding.

Emitters can be linked with a database or central station by any means, for purposes including status reporting, changing emitted codes, and instructions specific to a given class or credential or individual credential ID.

A visible indicator (or non-visible emission or response) from a credential can be used (including by pulse coding) to allow for unattended access points, such as doorways and gates. With the credential in sufficient proximity to a detector, upon recognition of an authorizing emission, a relay closure or other means can enable or cooperate in permitting entry.

What is claimed is:

1. Apparatus for redirecting a light beam formed by a light fixture, said beam having a centerline, said centerline elongating in the direction of beam propagation, said apparatus comprising:

a first mirror, a first support, said first support maintaining said first mirror in said beam such that during said redirection of said light beam said first mirror reflects said beam in a direction rotationally fixed with respect to said centerline in said beam as incident upon said first mirror and so as to form an included angle between said centerline before and after said reflection of greater than 90 degrees, a second mirror, a second support, said second support for positioning said second mirror to reflect said beam in a plurality of possible angles variable in two transverse axes, a first actuator, said first actuator coupled to said second support so as to adjust said second mirror in one of said two transverse axes, a second actuator, said second actuator coupled to said second support so as to adjust said second mirror in the other of said two transverse axes.

2. Apparatus for redirecting a light beam formed by a light fixture, said beam having a centerline, said centerline elongating in the direction of beam propagation, said apparatus comprising:

a first mirror, a first support, said first support maintaining said first mirror in said beam such that during said redirection of said light beam said first mirror is fixed in orientation in all axes and reflects said beam as incident upon said first mirror so as to form an included angle between said centerline before and after said first reflection of greater than 90 degrees, a second mirror, a second support, said second support for positioning said second mirror to reflect said beam after said first reflection again in a plurality of possible angles variable in two transverse axes, a first actuator, said first actuator coupled to said second support so as to adjust said second mirror in one of said two transverse axes, a second actuator, said second actuator coupled to said second support so as to adjust said second mirror in the other of said two transverse axes.

* * * * *